United States Patent [19]

Nishi et al.

[11] Patent Number: 4,761,628

[45] Date of Patent: Aug. 2, 1988

[54] ELECTROMAGNETIC INDUCTION APPARATUS WITH TAP WINDING CONDUCTORS

[75] Inventors: Hideji Nishi; Katsumi Kondo, both of Ako, Japan

[73] Assignee: Mitsubishi Denki Kabushiki Kaisha, Japan

[21] Appl. No.: 133,927

[22] Filed: Dec. 17, 1987

[30] Foreign Application Priority Data

Dec. 24, 1986 [JP] Japan ..... 61-306486

[51] Int. Cl.[4] ..... H01F 27/28; H01F 15/10

[52] U.S. Cl. ..... 336/180; 336/192; 336/223; 336/232

[58] Field of Search ..... 336/150, 192, 223, 232, 336/180; 323/340, 341, 255, 256

[56] References Cited

U.S. PATENT DOCUMENTS

| | | | |
|---|---|---|---|
| 2,757,347 | 7/1956 | Pozaruski | 336/192 |
| 2,866,955 | 12/1958 | Mees et al. | 336/192 |
| 2,949,593 | 8/1960 | Staley et al. | 336/232 X |
| 3,185,946 | 5/1965 | Johnson | 336/192 X |
| 3,337,828 | 8/1967 | Vargo | 336/192 |
| 3,747,038 | 7/1973 | McGill | 336/180 R |

*Primary Examiner*—Thomas J. Kuzma

*Attorney, Agent, or Firm*—Leydig, Voit & Mayer

[57] ABSTRACT

An electromagnetic induction apparatus having an even number of coaxially disposed flat coils each having a main winding conductor and tap winding conductors wound in parallel along at least a portion of the main winding conductor to form together a flat coil. The main winding conductors are connected together by connecting the inner end of the main winding conductor of each odd-numbered one of the even number of flat coils to the inner end of the main winding conductor of the adjacent even-numbered flat coil, and connecting the outer end of the main winding conductor of the even-numbered flat coil to the outer end of the main winding conductor of the succeeding odd-numbered flat coil. The tap winding conductors are connected together by connecting the inner end of each of the tap winding conductors of each odd-numbered one of the even number of flat coils to the inner end of the corresponding tap winding conductor of the adjacent even-numbered flat coil, and connecting the outer end of each of the tap winding conductors of the even-numbered flat coil to the outer end of the corresponding tap winding conductor of the succeeding even-numbered flat coil. Upright lead portions are formed on each of the outer ends of both the main winding conductors and the tap winding conductors of flat coils which are located at opposite ends of the even number of flat coils.

2 Claims, 4 Drawing Sheets

ELECTROMAGNETIC INDUCTION APPARATUS WITH TAP WINDING CONDUCTORS

BACKGROUND OF THE INVENTION

The present invention relates to a winding structure which is applicable to an electromagnetic induction apparatus.

FIG. 1 is a diagrammatic perspective view of a typical example of the prior art winding structure of such an electromagnetic apparatus. As shown, a pair of flat coils 1 and 2 (hereinafter referred to simply as "coils") are wound substantially coaxially with respect to each other. The coils 1 and 2 include winding conductors whose inner ends are connected to each other at a connection P to connect the coils 1 and 2 in series. These coils 1 and 2 further include a plurality of tap leads 3 each of which have one end connected to an intermediate portion of the winding conductor and which extend in a direction intersecting the outer peripheries of the corresponding coils 1 and 2. The outer portions of the coils 1 and 2 including the tap leads 3 are hereinafter referred to as "tap winding portions" (the non-hatched portions in the figure) while the inner portions of the coils 1 and 2 including no tape leads 3 are hereinafter referred to as "main winding portions" (the hatched portions in the figure). The tap winding portions of the coils 1 and 2 are provided with transposition points Q in order to cancel the circulating currents generated in the tap winding portions.

Referring to FIG. 2, which is a circuit diagram of the winding structure shown in FIG. 1, the series-connected coils 1 and 2 each include a plurality of tap leads 3 (in this example, three tap leads for each coil).

FIG. 3 is a diagrammatic side view taken in the direction of an arrow A of FIG. 1. A distance $d_1$ represents the insulation distance between the tap leads 3 of the coil 1 and the tap leads 3 of the coil 2. A distance $d_2$ represents the insulation distance between the coil 1 and the tap leads 3 attached thereto and between the coil 2 tap leads 3 attached thereto. A distance $d_3$ represents the insulation distance between the coils 1 and 2.

FIGS. 4 and 5 illustrate typical examples of the shape of the winding conductor at the transposition points Q of the coils 1 and 2. FIG. 4 shows one example which has no joint area while FIG. 5 shows another example which has a joint.

The tap leads 3 are connected to the winding conductor of the corresponding coil 1 or 2, as shown in FIG. 6.

In the prior art electromagnetic induction apparatus as arranged above, the tap leads 3 are connected directly to the winding conductors of the coil so as to form tap portions. Also, in order to cancel the circulating currents generated in the tap winding portion, at the transposition points Q of the coils 1 and 2, the corresponding winding conductors must be transposed by being twisted 180° about their center lines (shown by the dot-dash line in FIG. 4).

It is to be noted that, although in the example of FIG. 4 there is no joint area, the winding conductors may also have a joint connecting them to each other as shown in FIG. 5.

The prior art electromagnetic induction apparatus having the above-described arrangement includes a winding structure in which the tap leads are connected directly to the winding conductors, as shown in FIG. 6. For this reason, it is necessary to maintain the insulation distances $d_2$ between the coil 1 and the tap leads 3 attached thereto and between the coil 2 and the tap leads 3 attached thereto, as shown in, for exmaple, FIG. 3. This prior art winding structure has a disadvantage in that this necessity increases the whole size of the electromagnetic induction apparatus. In addition, in order to connect the tap leads to the winding conductors, additional work is required to peel an insulating coating from the portions of the winding conductors to which the tap leads are to be connected. This presents a problem in that in assemblying the electromagnetic induction apparatus is reduced. In addition, as shown in FIGS. 4 and 5, in order to cancel the circulating currents generated in the tap winding portions, transpositions must be effected in the winding portions. This makes it more difficult to form the windings. The prior art electromagnetic induction apparatus involves the above-described problems.

SUMMARY OF THE INVENTION

It is therefore an object of the present invention to provide an electromagnetic induction apparatus having a coil winding structure which can be provided with a given number of tap leads without any need to make the tap leads project from the side surfaces of the coil, by connecting in a prior art manner one end of each of the tap leads directly to the winding conductor of the coil.

It is another object of the present invention to provide an electromagnetic induction apparatus having a winding structure which does not need the insulation distance (shown as the insulation distances $d_2$ in FIG. 3) between each coil and the tap leads attached thereto respectively, reducing the insulation distance $d_3$ between the coils.

It is another object of the present invention to provide an electromagnetic induction apparatus having a winding structure provided with a winding portion without any transpositions which function to cancel the circulating currents generated in tap winding portion thereof.

The above and other objects are achieved by the present invention which provides an electromagnetic induction apparatus having an even number of flat coils each having a main winding conductor and tap winding conductors which are the same in number as the taps and which are wound in parallel along at least a portion of the main winding conductor to form, together with said main winding conductor, a flat coil, the flat coils being wound substantially coaxially; means for connecting the main winding conductors together by connecting the inner end of the main winding conductor of each odd-numbered one of the even number of flat coils to the inner end of the main winding conductor of the adjacent even-numbered flat coil, and connecting the outer end of the main winding conductor of the even-numbered flat coil to the outer end of the main winding conductor of the succeeding odd-numbered flat coil; means for connecting the tap winding conductors together by connecting the inner end of each of the tap winding conductors of each odd-numbered one of the even number of flat coils to the inner end of the corresponding tap winding conductor of the adjacent even-numbered flat coil, and connecting the outer end of each of the tap winding conductors of the even-numbered flat coil to the outer end of the corresponding tap winding conductor of the succeeding even-numbered flat coil; and upright lead portions formed on each of the outer ends of both the main winding conductors and the tap winding conductors of flat coils which are located at opposite ends of the even number of flat coils.

The electromagnetic induction apparatus of the present invention includes an improved coil structure, that is, a coil structure in which an even number of flat coils are connected in series and in side-by-side relationship, a desired number of taps are formed by winding the tap winding conductors parallel to one another around a portion or the whole of the main winding conductor. This structure eliminates the need to make the tap leads project from the side surfaces of the coil by directly connecting one end of each of the tap leads to the winding conductors.

Further objects, features and advantages of the present invention will become apparent from the following description of a preferred embodiment of the present invention with reference to the accompanying drawings.

BRIEF DESCRIPTION OF THE PREFERRED EMBODIMENT

A preferred embodiment of the present invention will be described below with reference to the accompanying drawings.

Figure 7:
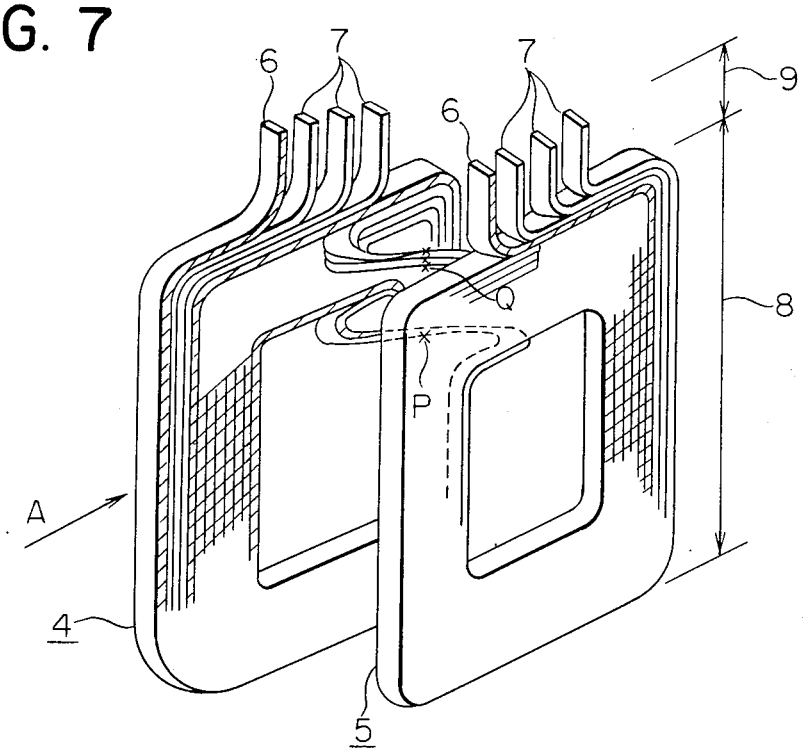
FIG. 7 is a diagrammatic perspective view of a preferred embodiment of an electromagnetic induction apparatus of the present invention.

FIG. 7 is a diagrammatic perspective view of the winding structure of an electromagnetic induction apparatus constituting the preferred embodiment of the present invention. As shown, each of flat coils 4 and 5 (hereinafter referred to simply as "coils") includes a main winding conductor 6 (the hatched portion) and a plurality of (in this embodiment, three) tap winding conductors 7 (the non-hatched portion) which are wound parallel to one another around a portion of the main winding conductor 6.

Figure 4:
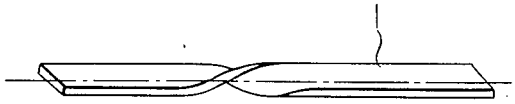
FIG. 4 PRIOR ART
FIG. 4 is a diagrammatic illustration of the shape of the portion of a winding structure around a transposition, showing an example with no connection.
Figure 5:
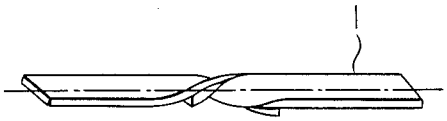
FIG. 5 PRIOR ART
FIG. 5 is a diagrammatic illustration of the shape of the portion of a winding structure of a transportation, showing another example containing a connection.
Figure 8:
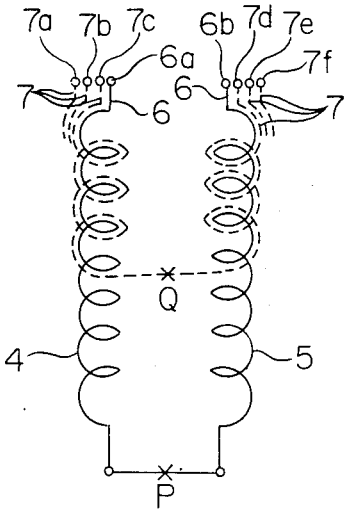
FIG. 8 is a circuit diagram of the electromagnetic induction apparatus shown in FIG. 7.

As shown in FIG. 8, the inner ends of the main winding conductors 6 of the coils 4 and 5 are connected to each other, and further the inner ends of the tap winding conductors 7 of the coil 4 are connected to the corresponding inner ends of the tap winding conductors 7 of the coil respectively. More specifically, the inner ends of the main winding conductors 6 of the coils 4 and 5 are connected to each other at a connection P which serves as means for connecting the main winding conductors. The inner ends of the tap winding conductors 7 of the coils 4 are connected to those of the coils 5 at corresponding transposition points Q which serve as means for connecting the tap winding conductors. The transposition points Q are shaped as shown in FIG. 4 or 5 illustrating the prior art, in order to cancel the circulating currents produced in the tap winding conductors 7. The portions of each of the coils 4 and 5 which are wound into a coiled form are hereinafter referred to as the "winding portions 8" while the respective upright portions of the main winding conductor 6 and the tap winding conductors 7 are hereinafter referred to collectively as "upright lead portions 9".

FIG. 8 is a circuit diagram of the embodiment shown in FIG. 7, in which reference characters 4 to 7, P and Q represent the same components as those shown in FIG. 7. The coils 4 and 5 each include the main winding conductor 6 shown as solid lines and the tap winding conductors 7 shown as broken lines, these tap winding conductors 7 being wound parallel to one another around a portion of the main winding conductor 6. The inner end of the main winding conductor 6 of the coil 4 is connected to that of the inner end of the main winding conductor 6 of the coil 5 while the inner ends of the tap winding conductors 7 of the coil 4 are connected to the corresponding inner ends of the tap winding conductors 7 of the coil 5 respectively.

Figure 9:
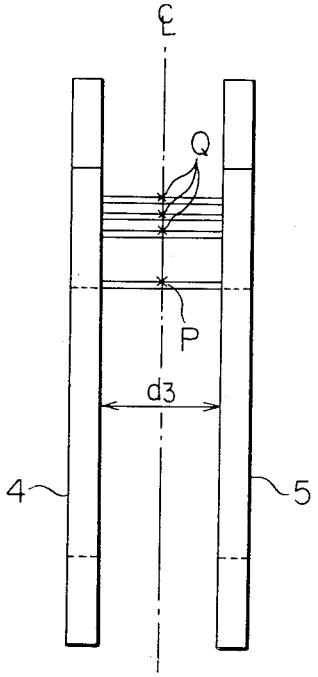
FIG. 9 is a diagrammatic side elevation of the electromagnetic induction apparatus shown in FIG. 7.

FIG. 9 is a diagrammatic side view taken in the direction of an arrow A of FIG. 7, in which reference characters 4, 5, P and Q represent the same constituent elements as those shown in FIG. 7. A distance $d_3$ represents the insulation distance between the coils 4 and 5.

Figure 10:
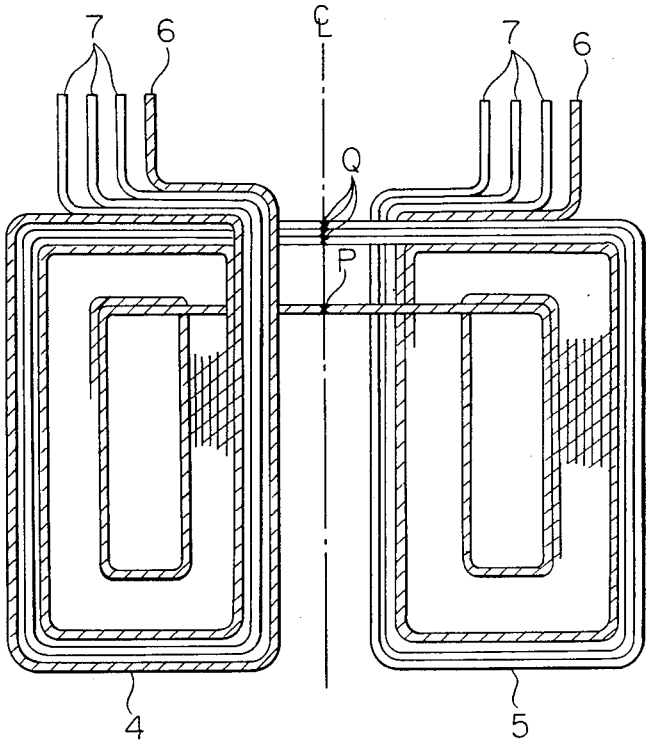
FIG. 10 is a diagrammatic view of the electromagnetic induction apparatus in FIGS. 7 and 9.

FIG. 10 is a development view of FIGS. 7 and 9, illustrating the coils 4 and 5 developed along the center line shown by the dot-dash line in FIG. 9. Reference characters 4 to 7, P and Q in FIG. 10 represent the same components as those shown in FIGS. 7 and 9, and, in the same manner as FIG. 7, the hatched portions of the coils 4 and 5 represent the main winding conductors 6 while the non-hatched portions of the coils 4 and 5 represent the tap winding conductors 7.

Figure 1:
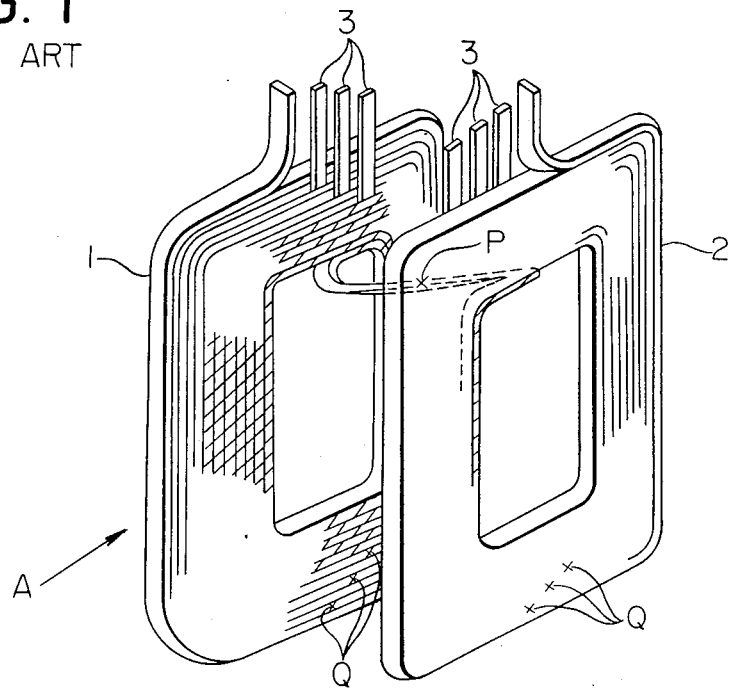
FIG. 1 PRIOR ART
FIG. 1 is a diagrammatic perspective view of a typical example of the winding structure of a prior art electromagnetic induction apparatus.
Figure 2:
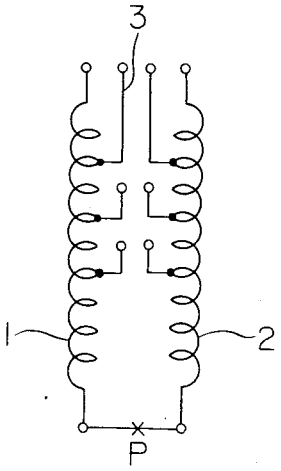
FIG. 2 PRIOR ART
FIG. 2 is a circuit diagram of the electromagnetic induction apparatus shown in FIG. 1.
Figure 3:
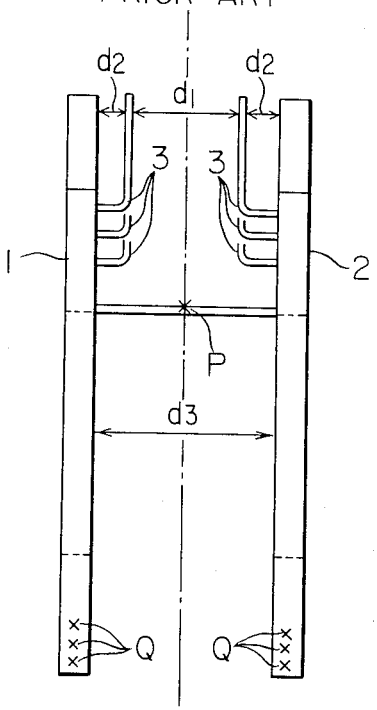
FIG. 3 PRIOR ART
FIG. 3 is a diagrammatic side elevation of the electromagnetic induction apparatus shown in FIG. 1.
Figure 6:
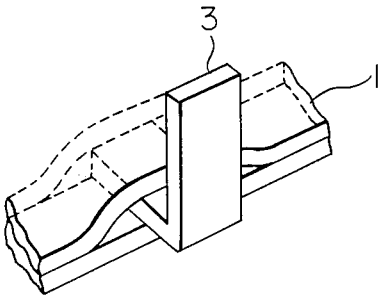
FIG. 6 PRIOR ART
FIG. 6 is a diagrammatic illustration of the shape of the connection between the winding structure and the tap lead.

In the electromagnetic induction apparatus having the above-described arrangement, the tap winding conductors 7 are wound in parallel around at least a portion of each of the main winding conductors 6, and the upright lead portions 9 of the tap winding conductors 7 are employed as tap leads. This arrangement eliminates the necessity for other tap leads to be connected directly to the winding conductors of the coils 4 and 5 in the manner described previously in the prior art with reference to FIG. 6. Accordingly, the insulation distances $d_2$ shown in FIG. 3 are not needed, thereby enabling a reduction in the insulation distance $d_3$ between the coils 4 and 5, as shown in FIG. 9. Also, the transposition required for canceling the circulating currents produced in the tap winding conductors 7 can be effected at connecting portions between the coils 4 and 5 which are illustrated as the transposition points Q in FIGS. 7 to 10. In use, terminals 6*a*, 6*b* of the main winding conductors 6 and terminals 7*a* to 7*f* of the tap winding conductors 7 of the coils 4 and 5 can be connected to each other as required to provide a winding having a desired length. As shown in FIG. 8, for example, if, in the coil 5, the terminal 6*b* of the main winding conductor 6 is connected to the terminal 7*d* of the tap winding conductor 7 while, in the coil 4, the terminals 7*c* and 7*b* of the tap winding conductors 7 are connected to each other, the winding described below can be obtained. More specifically, the terminal 6a of the main winding conductor 6 of the coil 4 is connected via the connection P to the terminal 6*b* of the main winding conductor 6 of the coil 5 and, in addition, the terminal 6*b* is connected to the terminal 7*d* of the tap winding conductor 7. The terminal 6*b* is connected via the terminal 7*d* and the transposition point Q to the terminal 7*c* of the tap winding conductors 7 of the coil 4, and the terminal 7*c* is further connected to the terminal 7*b*. The terminal 7*c* is connected through the terminal 7*b* and the transposition point Q (the corresponding intermediate broken line is omitted) to the terminal 7*e* of the tap winding conductor 7 of the coil 5.

In the above-described embodiment, by way of example, the two coils are constituted by a combination of a main winding conductor and tap winding conductors, and, in both coils, the tap winding conductors are wound parallel to one another around a portion of the corresponding main winding conductor. Such an arrangement is not exclusive, and therefore the invention is not confined to the illustrative arrangement of the embodiment. For example, any even number of flat coils may be employed. In such a case, the inner ends of the main winding conductor and the tap winding conductors which constitute in combination an odd-numbered flat coil are connected to the corresponding inner ends of the main winding conductor and the tap winding conductors which constitute in combination an adjacent even-numbered flat coil. In addition, the outer ends of the main winding conductor and the tap winding conductors which constitute in combination the above even-numbered flat coil are connected to the corresponding outer ends of the main winding conductor and the tap winding conductors which constitute in combination a succeeding adjacent odd-numbered flat coil. With this arrangement, it is possible to construct any desired even number of flat coils.

Also, in the above-described embodiment, three tap leads are provided for each coil by way of example. It is of course possible to form any given number of tap leads.

In the above-described embodiment, the three tap winding conductors are wound parallel to one another around the same portion of the main winding conductor, that is, each of the tap winding conductors forms the same number of turns as shown in FIG. 8. However, such an arrangement is only illustrative, and it is of course possible to change the number of turns of each of the tap winding conductors.

Although the upper portions of the flat coils are connected to each other in the above-described embodiment, the present invention is not limited solely to that arrangement. For example, the lower portions of the flat coils may be connected to each other instead. Alternatively, the connection may be formed at position intermediate opposing vertically-extending portions of the winding conductors of the coils.

As described above, in accordance with the present invention, the tap winding conductors are wound in parallel around at least a portion of each of the main winding conductors, and upright lead portions of the tap winding conductors are employed as tap leads. This arrangement eliminates the necessity for other tap leads to be connected directly to the winding conductors of the coils, thereby improving efficiency of assemblying the electromagnetic induction apparatus and reducing the distance between each coil. In addition, transposition is effected at the connections between the coils instead of in the winding portions of the coils. This further facilitates the formation of the coils.

What is claimed is:

1. An electromagnetic induction apparatus comprising:

an even number of flat coils each having a main winding conductor and tap winding conductors which are the same in number as taps and which are wound in parallel along at least a portion of said main winding conductor to form, together with said main winding conductor, a flat coil, said flat coils being wound substantially coaxially;

means for connecting said main winding conductors together by connecting the inner end of said main winding conductor of each odd-numbered one of said even number of flat coils to the inner end of said main winding conductor of the adjacent even-numbered flat coil, and connecting the outer end of said main winding conductor of said even-numbered flat coil to the outer end of said main winding conductor of the succeeding odd-numbered flat coil;

means for connecting said tap winding conductors together by connecting the inner end of each of said tap winding conductors of each odd-numbered one of said even number of flat coils to the inner end of the corresponding tap winding conductor of the adjacent even-numbered flat coil, and connecting the outer end of each of said tap winding conductors of said even-numbered flat coil to the outer end of the corresponding tap winding conductor of the succeeding even-numbered flat coil; and upright lead portions formed on each of the outer ends of both the main winding conductors and the tap winding conductors of flat coils which are located at opposite ends of said even number of flat coils.

2. An electromagnetic induction apparatus according to claim 1, wherein said means for connecting said tap winding conductors includes a transposition point which functions to cancel the circulating currents generated in said tap winding conductors.

* * * * *